US008882060B2

(12) United States Patent
Vaughn et al.

(10) Patent No.: US 8,882,060 B2
(45) Date of Patent: Nov. 11, 2014

(54) GARBAGE BAG RETENTION RING

(71) Applicants: Teresa Gail Vaughn, Jupiter, FL (US); John D. Corbitt, Jr., Palm Beach Gardens, FL (US); Lori Anthony, Lake Worth, FL (US)

(72) Inventors: Teresa Gail Vaughn, Jupiter, FL (US); John D. Corbitt, Jr., Palm Beach Gardens, FL (US); Lori Anthony, Lake Worth, FL (US)

( * ) Notice: Subject to any disclaimer, the term of this patent is extended or adjusted under 35 U.S.C. 154(b) by 0 days.

(21) Appl. No.: 13/670,922

(22) Filed: Nov. 7, 2012

(65) Prior Publication Data

US 2014/0124630 A1 May 8, 2014

(51) Int. Cl.
*B65B 67/04* (2006.01)

(52) U.S. Cl.
USPC ..... 248/99; 248/95; 248/101; 141/390; 383/33

(58) Field of Classification Search
CPC ... B65B 7/1238; B65B 7/1233; B65F 1/1415; B65F 2210/138; B65F 1/06
USPC ..... 248/95, 99, 101; 141/390, 391; 383/33
See application file for complete search history.

(56) References Cited

U.S. PATENT DOCUMENTS

| | | | | | |
|---|---|---|---|---|---|
| 1,439,878 | A * | 12/1922 | Erhardt et al. | ..... | 248/101 |
| 1,588,094 | A * | 6/1926 | Chambers | ..... | 224/608 |
| 2,421,740 | A * | 6/1947 | Birch, Jr. | ..... | 248/101 |
| 2,654,892 | A * | 10/1953 | Szabo | ..... | 4/144.2 |
| 2,738,616 | A * | 3/1956 | Windle | ..... | 446/267 |
| 3,090,045 | A * | 5/1963 | Hurst | ..... | 2/7 |
| 3,893,649 | A * | 7/1975 | Cornell et al. | ..... | 248/99 |
| 4,026,340 | A * | 5/1977 | Sobolik | ..... | 383/33 |
| 4,946,118 | A * | 8/1990 | Hastings | ..... | 248/97 |
| 4,951,903 | A * | 8/1990 | Frey | ..... | 248/99 |
| 5,033,703 | A * | 7/1991 | Allen, Sr. | ..... | 248/97 |
| 6,517,034 | B1 * | 2/2003 | Kinchen | ..... | 248/99 |
| 6,843,453 | B1 * | 1/2005 | Rogers | ..... | 248/99 |
| 7,753,322 | B1 * | 7/2010 | Peterson | ..... | 248/99 |
| 7,883,062 | B2 * | 2/2011 | Zima | ..... | 248/99 |
| 8,449,185 | B1 * | 5/2013 | Koon | ..... | 383/33 |
| 2005/0274851 | A1 * | 12/2005 | Malik | ..... | 248/101 |
| 2010/0140423 | A1 * | 6/2010 | Davies et al. | ..... | 248/101 |
| 2010/0163691 | A1 * | 7/2010 | Peterson | ..... | 248/99 |

OTHER PUBLICATIONS

The Rumford Gardener MGR1000 Magic Ring Yard Cleanup Paper Bag Helper.

* cited by examiner

*Primary Examiner* — Anita M King
(74) *Attorney, Agent, or Firm* — Steven M. Greenberg, Esq.; Kara A. Brotman, Esq.; CRGO Law

(57) ABSTRACT

An apparatus for retaining the opening of a garbage bag is provided. A garbage bag retention ring can include a flexible and invertible base ring and a flexible and invertible retention ring fixed to the base ring. The base ring and the retention ring can each have about the same diameter. The base ring and the retention ring invert to expose an interior surface of the retention ring as an exterior surface. The garbage bag retention ring can further include at least one aperture formed between a junction of the base ring and the retention ring that is adapted to receive an edge of a circumferential portion of a garbage bag.

20 Claims, 5 Drawing Sheets

GARBAGE BAG RETENTION RING

BACKGROUND OF THE INVENTION

1. Field of the Invention

The present invention relates to gardening and, more particularly, to lawn maintenance.

2. Description of the Related Art

Garbage bags are disposable bags, which are typically made out of plastic, but can also be made out of cloth, used to contain trash. The material of garbage bags causes the opening of a garbage bag to be flimsy and collapsible unless it is placed in a container, such as a garbage can, with the sides of the bag being stretched over the lip of the container. Even when stretched over the lip of the container, a garbage bag does not always stay in place, falling into the bottom of the container, especially when something heavy is placed in the bag. In addition, the container with the garbage bag must be moved in order to fill the garbage bag or the bag itself must be lifted out of the container and moved, which often results in tears to the bag allowing the trash just collected to fall out of the bag and requiring it to be again collected.

If a garbage bag is not stretched over a lip of a container to keep it open, a garbage bag must be reopened each time it is to be used. This often results in dropping trash which was meant to be deposited in the bag on the ground or the inability to carry as much due to the need to keep one hand free to hold the bag open while placing trash in the bag.

BRIEF SUMMARY OF THE INVENTION

Embodiments of the present invention address deficiencies of the art with respect to maintaining the opening of a garbage bag and provide a novel and non-obvious an apparatus for maintaining the opening of a garbage bag without requiring a container to hold the garbage bag. In an embodiment of the invention, a garbage bag retention ring can be provided. The retention ring can include a flexible and invertible base ring and a flexible and invertible retention ring fixed to the base ring. The base ring and the retention ring can each have about the same diameter. Further, the base ring and the retention ring invert to expose an interior surface of the retention ring as an exterior surface. The garbage bag retention ring can further include at least one aperture formed between a junction of the base ring and the retention ring that is adapted to receive an edge of a circumferential portion of a garbage bag.

In a different embodiment, a garbage bag retention ring can include a flexible and invertible retention ring that can be inverted to expose an interior surface of the retention ring as an exterior surface and at least one aperture formed on a surface of the retention ring that is adapted to receive an edge of a circumferential portion of a garbage bag.

In yet an additional embodiment of a garbage bag retention ring can include a flexible and invertible base ring and a flexible and invertible retention ring fixed to the base ring. The base ring and the retention ring can each have about the same diameter. Further, the base ring and the retention ring invert to expose an interior surface of the retention ring as an exterior surface. Further, the garbage bag retention ring can include at least one aperture formed on a surface of the retention ring that is adapted to receive an edge of a circumferential portion of a garbage bag.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred; it being understood, however, that the invention is not limited to the precise arrangements and instrumentalities shown, wherein.

DETAILED DESCRIPTION OF THE INVENTION

Embodiments of the invention provide for a garbage bag retention ring. In accordance with an embodiment of the invention, two flexible rings can be stacked one atop another so that the top ring acts as a retention ring of the bottom ring. The retention ring can further include at least one slit adapted to receive an edge at a circumferential opening of a garbage bag. In this way, the edge of the circumferential opening of the garbage bag can be pulled through the slit to secure the garbage bag to the retention ring. The retention ring can be formed of a flexible material so as to allow the inversion of the retention ring with an interior surface of the retention ring becoming an exterior surface and the exterior surface of the retention ring becoming an interior surface. The repeated inversion of the retention ring whilst an edge of a circumferential portion of a plastic garbage bag has been pulled through the slit can result in the folding upon itself of the circumferential portion of the garbage bag. This enables the garbage bag to remain open without requiring a container or requiring the use of one's hands to open the garbage bag in order to fill it.

Figure 1A:
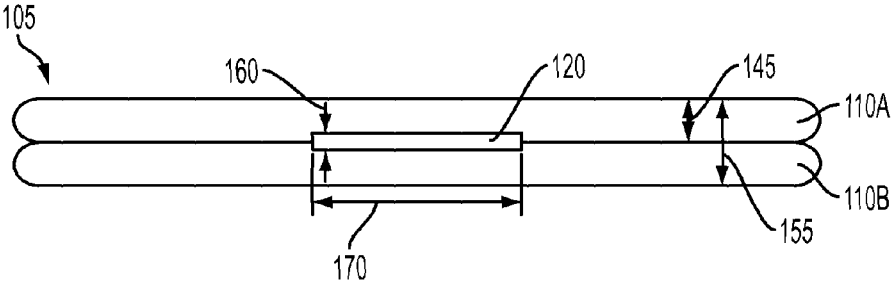
FIG. 1A is a side view of a garbage bag retention ring in an embodiment of the invention.

In further illustration, FIG. 1A shows a side view of a garbage bag retention ring 105 in an embodiment of the invention. The retention ring 105 can include at least one ring. In an embodiment, a second ring 110B can be positioned directly underneath a first ring 110A. The two rings 110A, 110B can be coupled to form a retention ring 105. In this way, the stacked rings 110A, 110B can create a retention ring 105 with a ridge or lip. The two rings 110A, 110B can be coupled using any technique now known or later developed, including but not limited to, gluing and welding. Further, each ring 110A, 110B can be manufactured using any technique now known or later developed, including extrusion and injection molding. Of note, each ring 110A, 110B can also be made of multiple pieces of material that are coupled together to form a single ring 110A, 110B. The multiple pieces of material can be coupled using any technique now known or later developed, including but not limited to gluing, welding, and fastening. The thickness 145 of each ring 110A, 110B as well as the overall thickness 155 can vary, but in an embodiment, each ring 110A, 110B can have a thickness (diameter) 145 of about a quarter of an inch, making the overall thickness 155 of a retention ring 105 about half an inch.

Each ring 110A, 110B can be made of any material now known or later developed, including but not limited to rubber, plastic, or an amalgamation of materials, including rubber and plastic. In this way, the retention ring 105 is flexible so it can be repeatedly inverted, resulting in the securing of a garbage bag onto the retention ring 105. Inverting the retention ring 105 results in exposing an interior surface of the retention ring 105 as an exterior surface. The repeated process of inverting the ring 105 results in the folding or rolling of a garbage bag around the ring 105. Further, the flexibility of the material enables force (pressure) to be applied to the retention ring 105 to produce an alternative shape (at least temporarily). For example, an edge of a retention ring 105 with a garbage bag secured can be placed on the ground and pressure placed upon a top portion of the retention ring 105 resulting in a flattening of the bottom portion of the retention ring 105 (see FIG. 3B), which allows a user to more easily place trash, or rake leaves, for instance, into the garbage bag. In other words, the retention ring 105 can change from approximately round in shape to more oval-shaped, with one side being approximately flat or straight (contouring to the surface the retention ring 105 is disposed on). Once pressure is removed, the retention ring 105 regains its original shape.

In an embodiment, at least one aperture 120 can be located on the surface of the first ring 110A, second ring 110B, or both. In a different embodiment, the at least one aperture 120 can be formed between the two rings 110A, 110B. In other words, the rings 110A, 110B can be coupled in such a way that at least one aperture 120 is formed between a junction of a first ring 110A and a second ring 110B (FIG. 1A). Of further note, there can be just one aperture 120 or multiple, different apertures 120 formed between the rings 110A, 110B (the junction between each ring 110A, 110B) or anywhere on a surface of a first ring 110A, a second ring 110B, or both. Of even further note, in an embodiment, there can be two apertures 120, where each aperture 120 is positioned opposite the other. In other words, though FIG. 1A shows only one aperture 120, there can be a second aperture 120 that is not shown, opposite the pictured aperture 120. In another embodiment, the at least one aperture 120 can be positioned anywhere on a surface of a first ring 110A, a second ring 110B, or both. Of note, the location of an aperture 120 is not specifically defined. In other words, the at least one aperture 120 can be centered on either of the individual rings 110A, 110B forming the retention ring 105 or anywhere on the surface of a ring 110A, 110B.

The at least one aperture 120 can be of varying lengths 170 and width (gauge) 160. The at least one aperture 120 can be a slit. In an embodiment, the length 170 of an aperture 120 can be about one inch; in another embodiment, the length of the aperture 120 can be about three inches; and, in even a different embodiment, the length 170 of the aperture 120 can vary, being at least one inch and no more than three inches. Of note, the length 170 of the at least one aperture 120 can be less than one inch and greater than three inches. The width 160 of the aperture 120 is not limited to a specific size. The width 160 of the aperture 120 can be approximately equal to the overall width (thickness or gauge) of a portion of the garbage bag being threaded through an aperture 120. The overall width of a garbage bag can depend on what portion of the garbage bag is being threaded through an aperture 120. For example, if a garbage bag has a width of 0.8 millimeters, the aperture 120 may have a width 160 of about 0.8 millimeters if only one layer of the bag is pulled through the aperture 120. But if multiple layers are pulled through the aperture 120—for instance, if two layers of the bag are pulled through (or the bag is folded, such that one half of the bag is on top of the other)—then the width 160 of the aperture 120 may be closer to about 1.6 millimeters. In other words, the width 160 of the aperture 120 can be approximately equal to the width of the portion of the garbage bag being threaded. In an embodiment, the width 160 of at least one aperture 120 can be at least thirteen micrometers; in another embodiment the width 160 can be at least two millimeters; and, in a different embodiment, the width 160 can be at least 0.9 millimeters. Of note, the width 160 of the aperture 120 can be less than thirteen micrometers and greater than two millimeters. Of further note, the width 160 of the at least one aperture 120 is such that a portion of a robust garbage bag, especially of the type used for lawn and gardening trash, can be pulled (or threaded) through the at least one aperture 120 in order to secure a garbage bag to the retention ring 105. In other words, a width 160 of the at least one aperture 120 is of such size to create a friction fit between the aperture 120 and a portion of the garbage bag being threaded through the aperture 120, while still allowing the garbage bag to fit through the aperture 120.

Figure 1B:
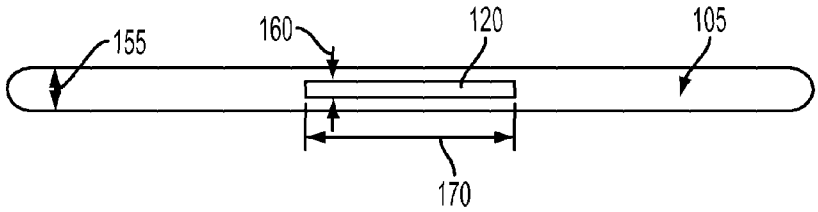
FIG. 1B is a side view of a garbage bag retention ring in an embodiment of the invention.

FIG. 1B is a side view of a garbage bag retention ring 105 in an embodiment of the invention. As shown in FIG. 1B, there is just one ring, a retention ring 105. In other words, there are not multiple, different rings coupled together to form a larger or thicker ring. In an embodiment, the retention ring is flexible and invertible so that the ring 105 can be inverted to expose an interior surface of the retention ring as an exterior surface. The retention ring 105 can be made of any material now known or later developed, including plastic, rubber, or an amalgamation of materials, including, but not limited to, plastic and rubber. The retention ring 105 can be manufactured using any technique now known or later developed, including extrusion and injection molding. Further, the retention ring 105 can be formed by coupling multiple, different pieces together to form the one retention ring 105. The overall thickness 155 is not limited to a specific dimension, but in an embodiment, the overall thickness 155 of a retention ring 105 can be about half an inch.

A retention ring 105 can include one aperture 120 or multiple, different apertures 120, which can be formed anywhere on a surface of a retention ring 105. In an embodiment, there can be two apertures 120, where each aperture 120 is positioned opposite the other. In other words, though FIG. 1B shows only one aperture 120, there can be a second aperture 120 that is not shown, which is opposite the pictured aperture 120. Further, the at least one aperture 120 can be a slit. The slit can vary in width (gauge) 160, so that a portion of an outdoor-type garbage bag, especially of the type used for lawn and gardening trash, can be pulled (or threaded) through the slit in order to secure a garbage bag to the retention ring 105. The width 160 of the aperture 120 is not limited to a specific size. In an embodiment, the width 160 of the aperture 120 is approximately equal to the portion of the garbage bag being passed through the aperture 120. In an embodiment, the width 160 of at least one aperture 120 can be at least thirteen micrometers; in another embodiment the width 160 can be at least two millimeters; and, in a different embodiment, the width 160 can be at least 0.9 millimeters. Of note, the width 160 of the aperture 120 can be less than thirteen micrometers and greater than two millimeters.

The at least one aperture 120 can be of varying lengths 170. In an embodiment, the length 170 of an aperture 120 can be about one inch; in another embodiment, the length 170 of the aperture 120 can be about three inches; and, in even a different embodiment, the length 170 of the aperture 120 can vary, being at least one inch and no more than three inches. Of note, the length 170 of the at least one aperture 120 can be less than one inch and greater than three inches.

The at least one aperture 120 can be positioned anywhere on a surface of a retention ring 105. In an embodiment, a retention ring 105 can have an aperture 120 positioned at the approximate center (tangent) of an outer surface of the retention ring 105, as shown in FIG. 1B, but, in a different embodiment, the at least one aperture 120 can be positioned elsewhere (anywhere on a surface of the retention ring 105).

Figure 1C:
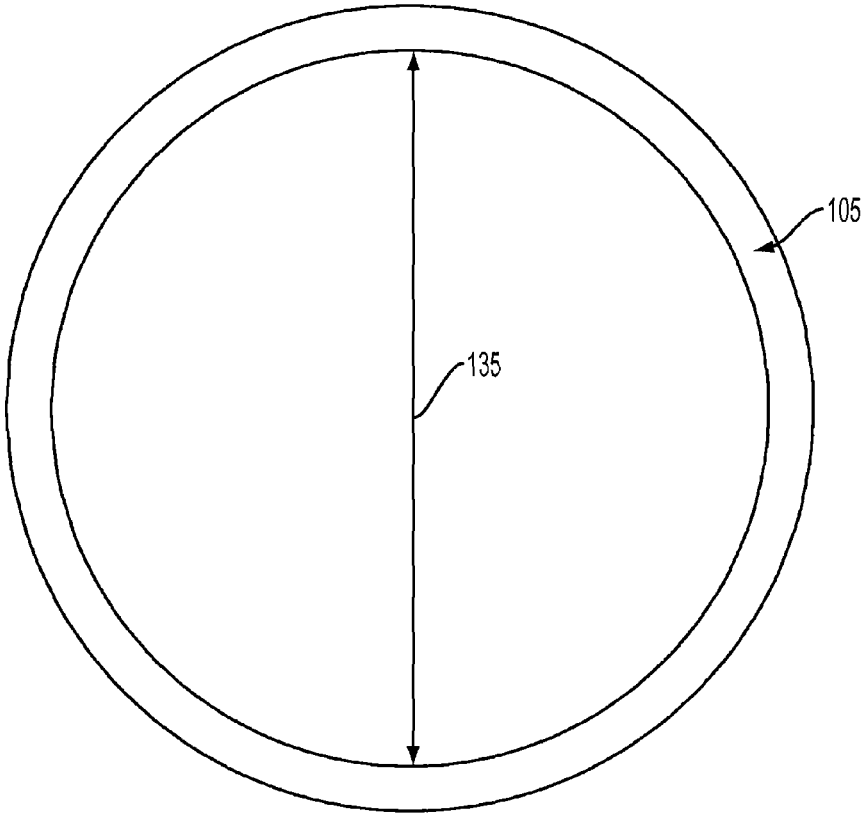
FIG. 1C is a top view of a garbage bag retention ring in an embodiment of the invention.

In further illustration, FIG. 1C illustrates a top view of a garbage bag retention ring 105 in an embodiment of the invention. As shown in FIG. 1C, the general shape of the retention ring is approximately round (circular), but the retention ring 105 is not limited to this shape. The retention ring 105 can be oval, rectangular, square, or any other shape that allows the retention ring 105 to be manipulated in such a way that it can be rolled over itself (inverted). The top view will appear the same regardless of whether a retention ring 105 is formed by stacking a multiplicity of rings (as shown in FIG. 1A, for example) or by one ring (as in FIG. 1B, for example). The overall diameter 135 of the retention ring 105 is not limited to a specific diameter. In an embodiment, the overall diameter 135 is about twenty inches; in another embodiment, the diameter 135 is about thirty inches; and in a different embodiment, the overall diameter 135 is at least about twenty inches and no more than about thirty inches. It is contemplated that the retention ring 105 can vary in overall diameter 135 so as to be used with outdoor garbage bags of varying sizes. Although they usually have a capacity of at least thirty gallons, these bags can have a sixty gallon capacity or larger, but can also have a capacity of less than thirty gallons.

Figure 2A:
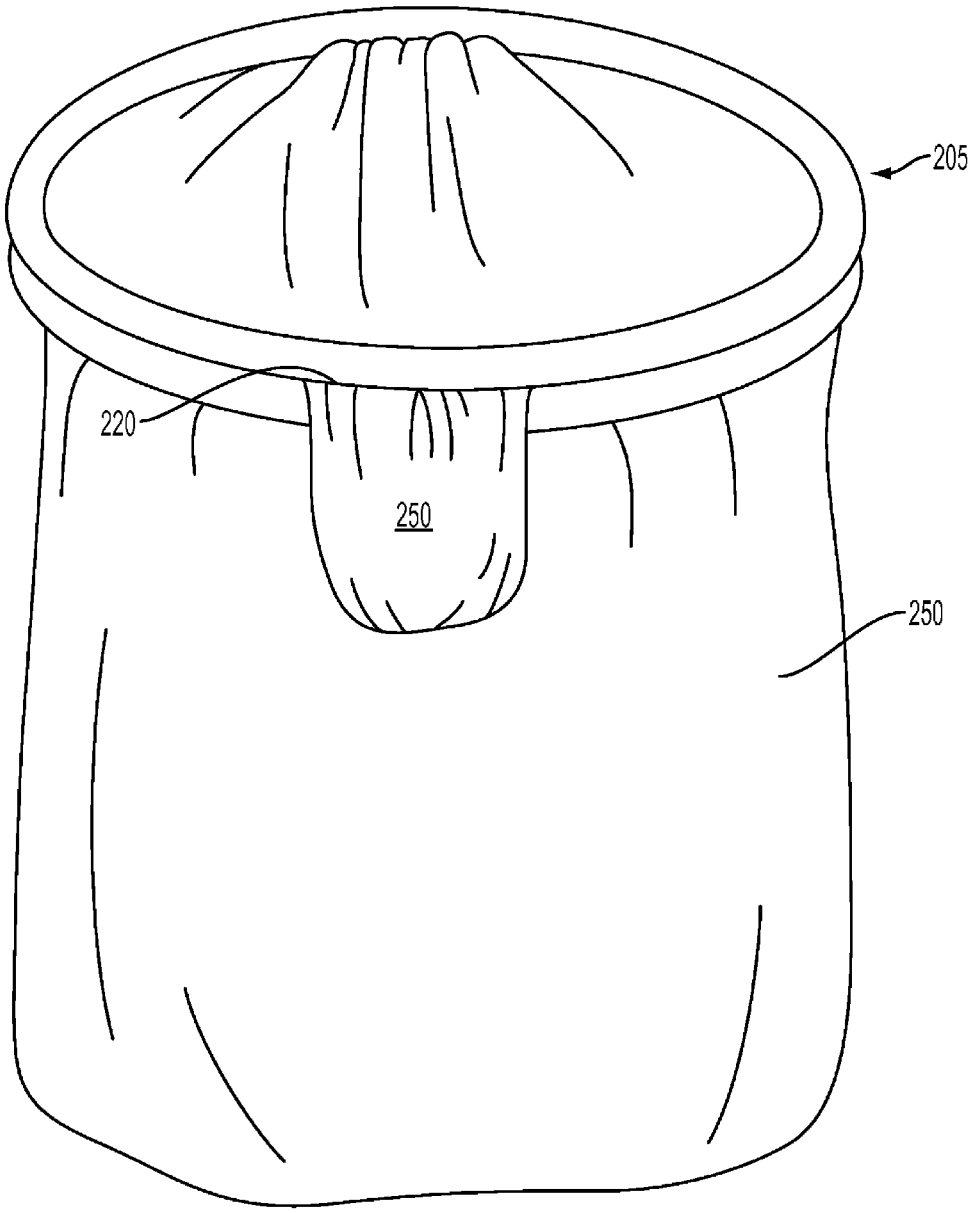
FIG. 2A illustrates a garbage bag being placed in an embodiment of a garbage bag retention ring for retaining the garbage bag in an open position.
Figure 3A:
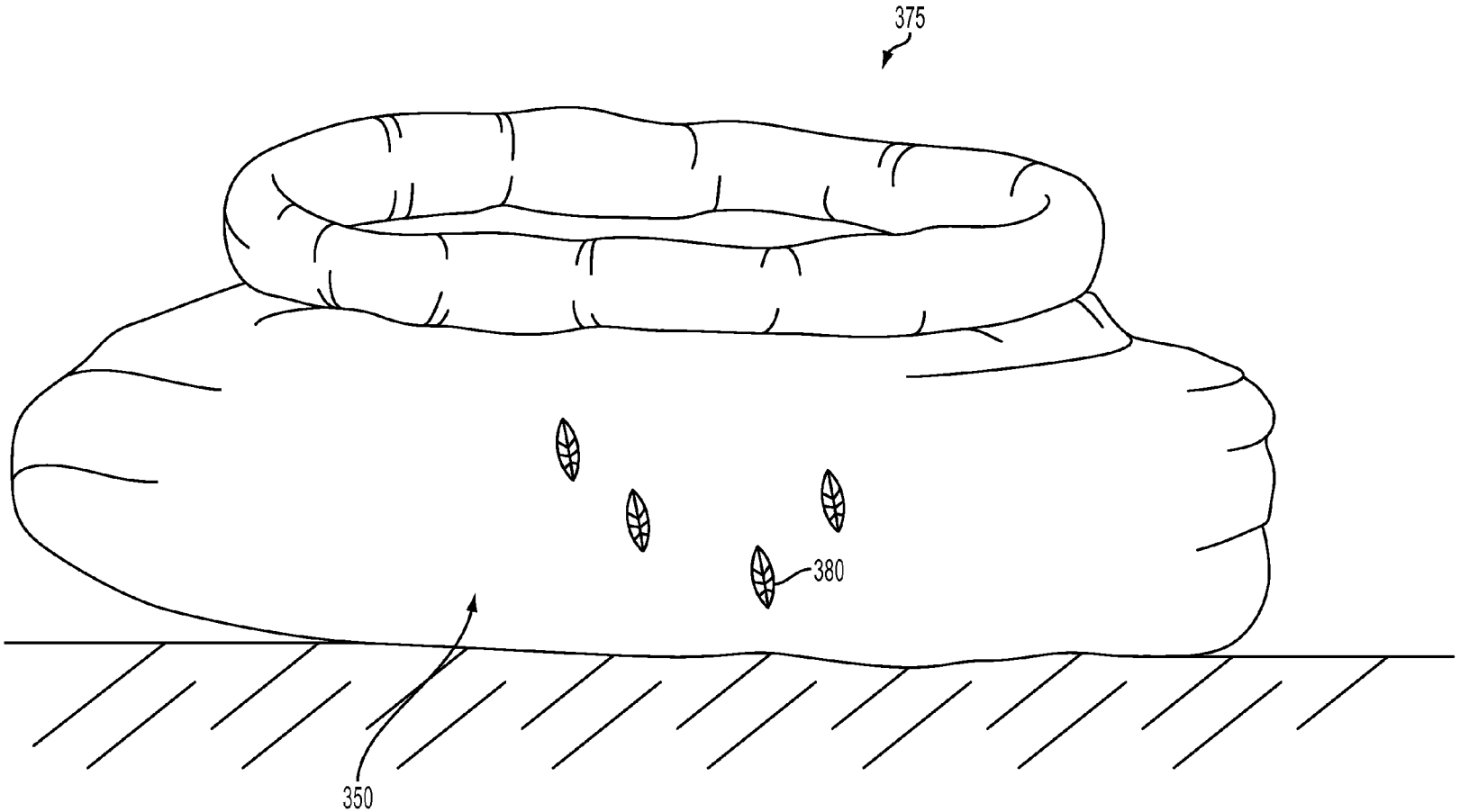
FIG. 3A shows a garbage bag ring retention system, where the garbage bag contains a portion of garbage; and, FIG. 3B is shows a garbage bag ring retention system on its side in an embodiment of the invention.
Figure 3B:
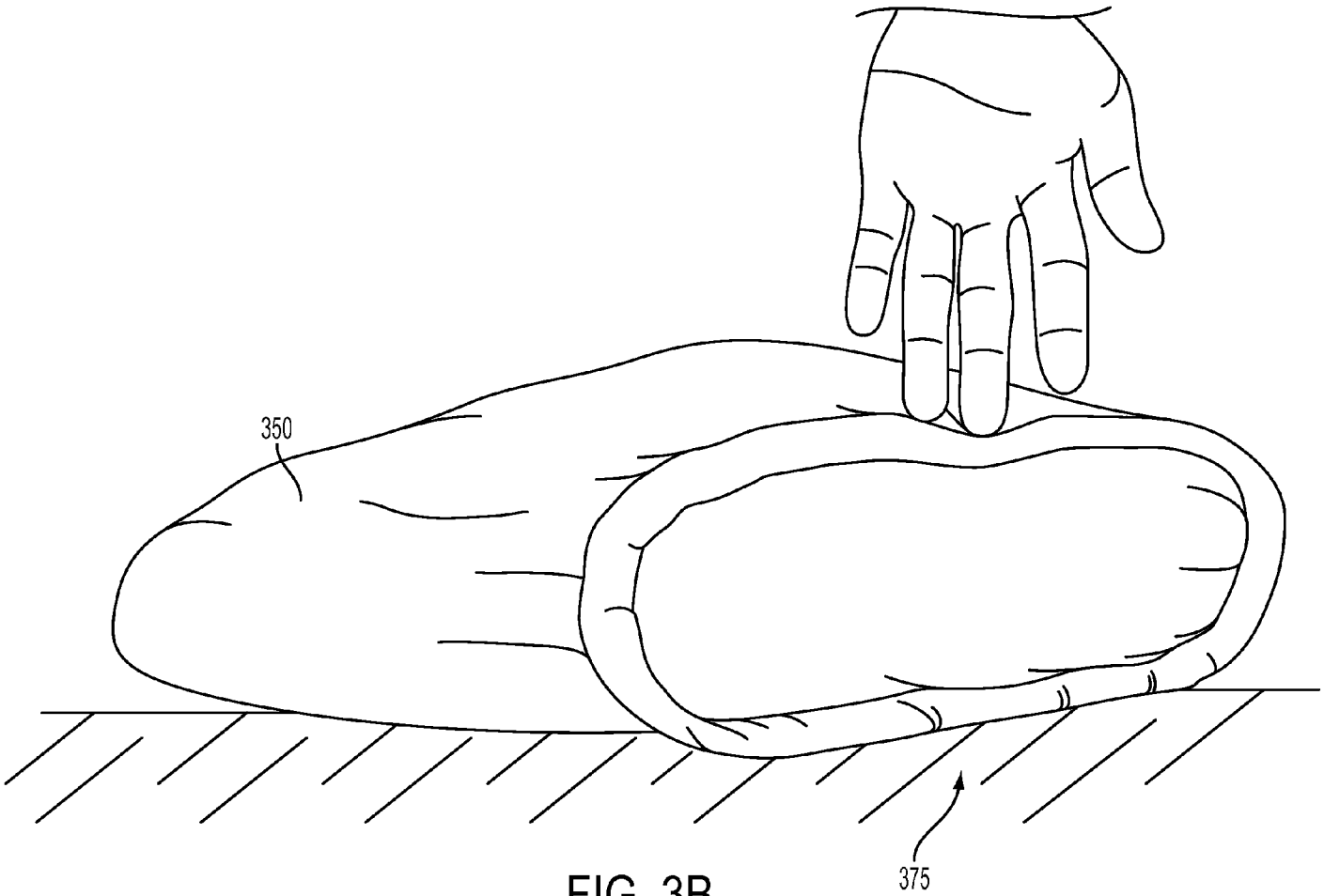

In yet further illustration, FIG. 2A shows a garbage bag 250 being placed in an embodiment of a garbage bag retention ring 205, for retaining the opening of a garbage bag 250. Of note, the garbage bag 250 can be made out of any material, including, but not limited to plastic, paper, and cloth. In an embodiment for retaining the opening of a garbage bag 250, a retention ring 205 can be placed on the outside of a garbage bag 250. The retention ring 205 can include at least one ring. Further, the retention ring 205 can include at least one aperture 220. Of note, the at least one aperture 220 can be a slit. The at least one aperture 220 can be positioned on a ring itself or between rings, in the case of a retention ring 205 formed by multiple stacked rings. As shown in FIG. 2A, there are two rings stacked one on top of another forming the retention ring 205, with two apertures 220 (one not seen) formed at a junction between the rings. Upon placing the retention ring 205 on the outside of the garbage bag 250, an edge of a circumferential portion of the garbage bag 250 can be secured to the retention ring 205 by any method now known or later developed, including taping and threading. For example, a portion of the garbage bag 250 can be threaded (pulled) through at least one aperture 220, as illustrated in FIG. 2A. The at least one aperture 220 adapted to receive an edge of a circumferential portion of a garbage bag. In embodiments with multiple, different apertures 220, multiple, different circumferential portions of the garbage bag 250 can be threaded through each aperture 220. Of note, in embodiments of a retention ring 205 where there are multiple apertures 220, not all apertures 220 need to be utilized. In other words, in an embodiment of a retention ring 205 with four apertures 220, different portions of a garbage bag 250 may be threaded through only two apertures 220 and in some cases, just one aperture 220. Once at least one portion of a garbage bag 250 is threaded through at least one aperture 220, the retention ring 205 can be manipulated in such a way that the garbage bag 250 is rolled around the retention ring 205 by rolling, flipping, or inverting the retention ring 205. For example, in an embodiment, the retention ring 205 can be rolled over on itself at least one time resulting in rolling the garbage bag 250 around the retention ring 205. In other words, the retention ring 205 can be inverted to expose an interior surface of the retention ring 205 as an exterior surface. The inversion of the ring 205 can be repeated. This results in retaining the mouth of a garbage bag 250 in an open position. In this way, the garbage bag 250 can remain open without requiring a container or requiring the use of one's hands to open the garbage bag 250, as illustrated in FIGS. 3A and 3B. The retention ring 205 can be removed from the garbage bag 250 by unrolling the garbage bag 250 and unsecuring any portion of the garbage bag 250 from the retention ring 205, such as unthreading the garbage bag 250 from any apertures through which a portion of the garbage bag 250 was initially threaded.

Figure 2B:
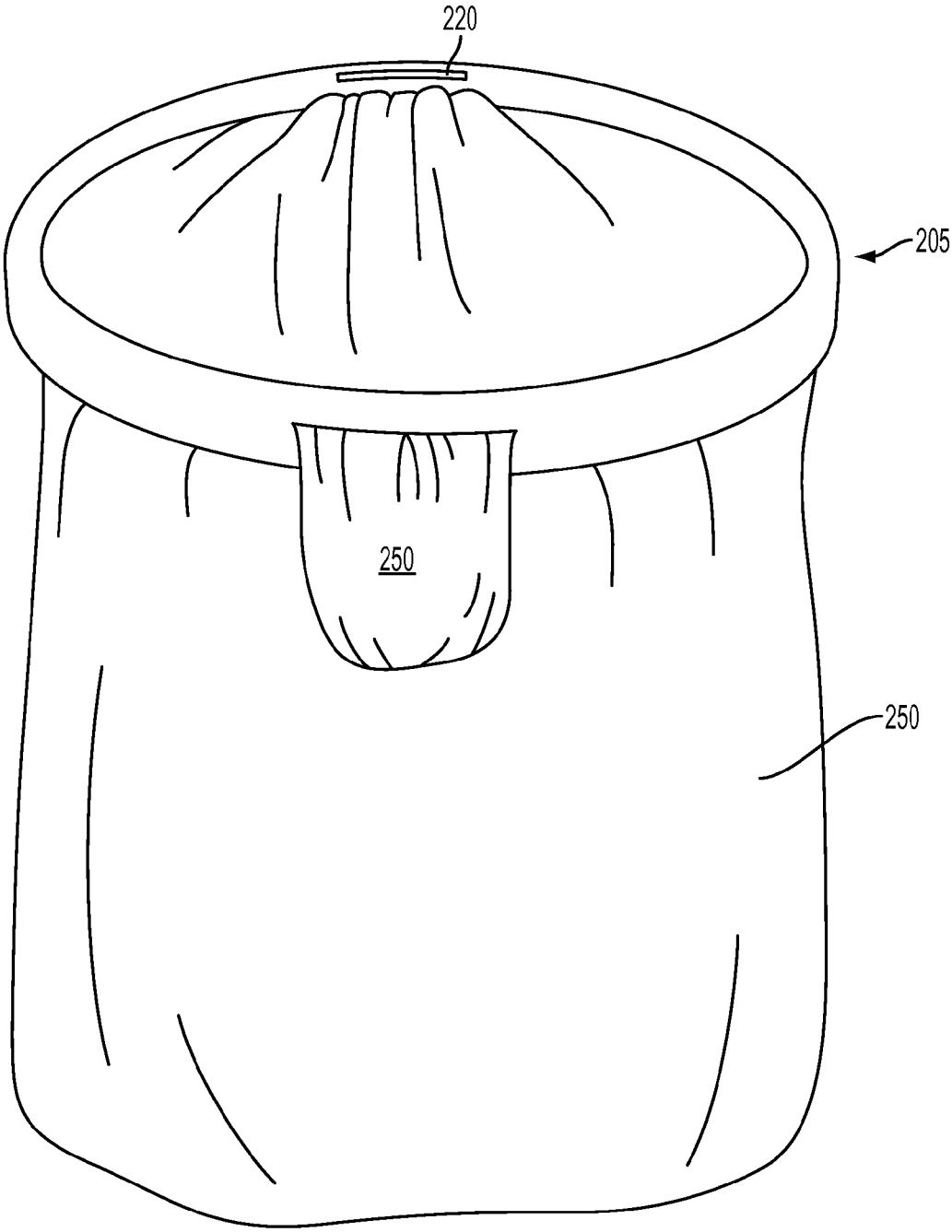
FIG. 2B illustrates a garbage bag being placed in an embodiment of a garbage bag retention ring for retaining the garbage bag in an open position.

In even further illustration, FIG. 2B shows a garbage bag 250 being placed in an embodiment of a garbage bag retention ring 205, for retaining the mouth of a garbage bag 250 in an open position. As shown in FIG. 2B, a retention ring 205, formed from one ring, can include two apertures 220. Of note, each aperture can be a slit. In an embodiment for retaining an open garbage bag 250, a retention ring 205 can be placed on the outside of a garbage bag 250. A portion of the garbage bag 250 can be secured to the retention ring 205. In one embodiment, an edge of a circumferential portion of the garbage bag 250 can be threaded (pulled) through at least one aperture 220, upon placing the retention ring 205 on the outside of the garbage bag 250. Optionally, a different portion of the garbage bag 250 can be threaded through a different aperture 220, if multiple, different apertures 220 are present. Of note, a portion of the garbage bag 250 can be secured to the retention ring 205 with any method now known or later developed; for instance, a portion of the garbage bag 250 can be taped to the retention ring 205.

Once at least one portion of a garbage bag 250 is secured to the retention ring 205, the retention ring 205 can be manipulated in such a way that the garbage bag 250 is rolled, inverted, flipped, or folded around the retention ring 205. The manipulation of the retention ring 205 causes an interior surface of the retention ring 205 to be exposed as an exterior surface. In an embodiment, the retention ring 205 can be rolled over on itself at least one time resulting in rolling or folding the garbage bag 250 around the retention ring 205. This results in maintaining the opening of a garbage bag 250, as seen in FIGS. 3A and 3B. In this way, the retention ring 205 maintains the opening of the garbage bag 250, so that garbage (or other items) can be placed within the garbage bag 250 without the garbage bag collapsing onto it each time something is placed in the garbage bag 250. The retention ring 205 can be removed from the garbage bag 250 by unrolling the garbage bag 250 and unsecuring the garbage bag 250 from the retention ring 205 (unthreading the garbage bag 250 from any apertures through which a portion of the garbage bag 250 was initially threaded).

In yet further illustration, FIG. 3A shows an embodiment of a garbage bag ring retention system 375, where the garbage bag 350 contains a portion of garbage 380. The garbage bag ring retention system 375 can include a garbage bag 350 secured to a retention ring (covered by the rolled garbage bag 350). The retention ring in a garbage bag ring retention system 375 can be formed by at least one ring. In an embodiment, the retention ring can include two rings with a first ring stacked approximately directly atop a second ring or base ring. In a different embodiment, the retention ring can include one ring. Further, the retention ring can include multiple, different apertures. In an embodiment, there can be two different apertures: each positioned approximately opposite the other. In another embodiment, multiple apertures can be positioned in a different configuration. In even another embodiment, there can be one aperture. The at least one aperture is configured in such a way to allow the garbage bag 350 to be passed through. In other words, the aperture has enough width through which an edge of a circumferential portion of the garbage bag 350 can be threaded. Of note, the aperture can be a slit. Of further note, the aperture can be positioned anywhere on a surface of the retention ring. For example, in an embodiment, the at least one aperture can be formed between a junction between two rings. In another example, multiple, different apertures can be positioned anywhere on a surface of the retention ring.

A garbage bag retention system 375 with the garbage bag 350 containing a portion of garbage (trash) 380 is shown in FIG. 3A. The retention ring 305 holds the garbage bag 350 open throughout the duration of its use. In an embodiment, the garbage bag 350 with the retention ring 305 can be placed on the ground, without the need of a container, while garbage 380 is being placed in the bag (through the opening maintained by the retention ring 305). As the garbage bag 350 is filled, the garbage bag 350 and retention ring 305 can remain upright and opened. In this way, a user does not need to use his or her hands to hold the garbage bag 350 open in order to place garbage 380 within.

In further illustration, FIG. 3B shows a garbage bag ring retention system 375, demonstrating the potential flexibility of the retention ring (covered by a garbage bag 350). The retention ring can be made from a pliable material, including but not limited to, rubber and plastic. The flexibility of the material enables force (pressure) to be applied to the retention ring to produce an alternative shape (at least temporarily). For example, an edge of a retention ring with a garbage bag secured can be placed on the ground and pressure placed upon a top portion of the retention ring resulting in a bottom portion of the retention ring flattening, so as to more easily place trash, or rake leaves, for instance, into the garbage bag. In other words, the retention ring can change from approximately round in shape to more oval-shaped with one side being approximately flat or straight (contouring to the surface of the retention ring on which it is disposed). Once pressure is removed, the retention ring regains its original shape, but continues to maintain the garbage bag 350 in an open position.

Having thus described the invention of the present application in detail and by reference to embodiments thereof, it will be apparent that modifications and variations are possible without departing from the scope of the invention defined in the appended claims as follows:

We claim:

1. A garbage bag retention ring, comprising:

a flexible and invertible base ring and a flexible and invertible retention ring fixed to the base ring, the base ring and the retention ring each having about the same diameter, the flexible base ring and the flexible retention ring being manually inverted to expose an interior surface of the retention ring as an exterior surface, the base ring and the retention ring each being circular; and, at least one aperture formed between a junction of the circular base ring and the circular retention ring that is adapted to receive an edge of a circumferential portion of a garbage bag.

2. The garbage bag retention ring of claim 1, wherein the flexible and invertible base ring and the flexible and invertible retention ring are each made of plastic.

3. The garbage bag retention ring of claim 1, wherein the flexible and invertible base ring and the flexible and invertible retention ring are each made of rubber.

4. The garbage bag retention ring of claim 1, wherein the diameters of the base ring and the retention ring are each at least about twenty inches and no more than about thirty inches.

5. The garbage bag retention ring of claim 1, wherein there are two apertures.

6. The garbage bag retention ring of claim 1, wherein the diameters of the base ring and the retention ring are each about twenty inches.

7. A garbage bag retention ring, comprising:

a flexible and invertible retention ring, the flexible retention ring inverting to expose an interior surface of the retention ring as an exterior surface; and, at least one aperture formed on a surface of the flexible and invertible retention ring that is adapted to receive an edge of a circumferential portion of a garbage bag.

8. The garbage bag retention ring of claim 7, wherein the flexible and invertible retention ring is made of plastic.

9. The garbage bag retention ring of claim 7, wherein the flexible and invertible retention ring is made of rubber.

10. The garbage bag retention ring of claim 7, wherein the diameter of the retention ring is at least about twenty inches and no more than about thirty inches.

11. The garbage bag retention ring of claim 7, wherein there are two apertures.

12. The garbage bag retention ring of claim 7, wherein the diameter of the retention ring is about twenty inches.

13. A garbage bag retention ring, comprising:

a flexible and invertible base ring and a flexible and invertible retention ring fixed to the base ring, the base ring and the retention ring each having about the same diameter, the flexible base ring and the flexible retention ring inverting to expose an interior surface of the retention ring as an exterior surface; and, at least one aperture formed on at least one surface of the flexible and invertible retention ring or the flexible and invertible base ring that is adapted to receive an edge of a circumferential portion of a garbage bag.

14. The garbage bag retention ring of claim 13, wherein the flexible and invertible base ring and the flexible and invertible retention ring are each made of plastic.

15. The garbage bag retention ring of claim 13, wherein the flexible and invertible base ring and the flexible and invertible retention ring are each made of rubber.

16. The garbage bag retention ring of claim 13, wherein the diameters of the base ring and the retention ring are each at least about twenty inches and no more than about thirty inches.

17. The garbage bag retention ring of claim 13, wherein there are two apertures.

18. The garbage bag retention ring of claim 13, wherein the at least one aperture is a slit.

19. The garbage bag retention ring system of claim 13, wherein the at least one aperture is located at a tangent to an outer surface of the retention ring.

20. The garbage bag retention ring of claim 13, wherein the diameters of the base ring and the retention ring are each about twenty inches.

* * * * *